US005279003A

United States Patent [19]

Gape et al.

[11] Patent Number: 5,279,003

[45] Date of Patent: Jan. 18, 1994

[54] JET UNITS FOR WHIRLPOOL-BATH SYSTEMS

[75] Inventors: Alan F. Gape, Liphook; David S. O. Butler, Elstead, both of England

[73] Assignee: PH Pool Services Limited, England

[21] Appl. No.: 828,979

[22] PCT Filed: Aug. 2, 1990

[86] PCT No.: PCT/GB90/01208

§ 371 Date: Jan. 31, 1992

§ 102(e) Date: Jan. 31, 1992

[87] PCT Pub. No.: WO91/01675

PCT Pub. Date: Feb. 21, 1991

[30] Foreign Application Priority Data

Aug. 4, 1989 [GB] United Kingdom ..... 8917882

[51] Int. Cl.[5] ..... A61H 33/02

[52] U.S. Cl. ..... 4/541.6; 239/425.5

[58] Field of Search ..... 4/541.6, 541.5, 541.4

[56] References Cited

U.S. PATENT DOCUMENTS

| | | | |
|---|---|---|---|
| 1,526,179 | 2/1925 | Parr et al. | 4/541.6 X |
| 3,297,025 | 1/1967 | Jacuzzi | 4/541.6 X |
| 3,890,656 | 6/1975 | Mathis | 4/541.6 X |
| 4,443,335 | 4/1984 | Gullace . | |
| 4,586,204 | 5/1986 | Daniels | 4/541.6 X |
| 4,710,990 | 12/1987 | Morsey | 4/541.6 |
| 4,742,965 | 5/1988 | Messinger et al. | 4/541.6 X |
| 5,000,665 | 3/1991 | Moeller | 4/541.6 X |
| 5,142,714 | 9/1992 | Klotzbach | 4/541.6 |
| 5,182,820 | 2/1993 | Marks | 4/541.4 |

FOREIGN PATENT DOCUMENTS 0351813 7/1989 European Pat. Off. .

*Primary Examiner*—Daniel M. Yasich

*Attorney, Agent, or Firm*—Davis, Bujold & Streck

[57] ABSTRACT

The fixed-direction jet units (1) of a whirlpool-bath system each include a nozzle (18) for supplying water under pressure from a tube-section (17) to an outlet (12) across an air gap (20) within a chamber (19). The unit (1) is clamped to the bath-wall (14) between a flange (16) of the outlet (12) and the unit housing (15). The flow of water from the nozzle (18) across the gap (20) into the axially-aligned stem (13) of the outlet (12) draws air into the chamber (19) from an inlet pipe (21) that is coupled to a distribution manifold (7) of an air-supply controller (9) by an individual supply tube (8). A circumferential skirt (22) projects backwardly from the stem (13) to shroud the gap (20) over a frusto-conical nose-part (23) of the nozzle (18), so that air is constricted to enter the gap (20) through the annular space (24) between them. The constriction evens out air flow around the stream of water from the nozzle (18), enhancing small-bubble distribution in the stream and the consequent foaming and turbulence of the jet discharged from the outlet (12). The cross-sectional area of the pathway for air between the nozzle nose-part (23) and the skirt (22) increases towards the gap (20), but may be substantially uniform.

14 Claims, 4 Drawing Sheets

JET UNITS FOR WHIRLPOOL-BATH SYSTEMS

Figure 1:
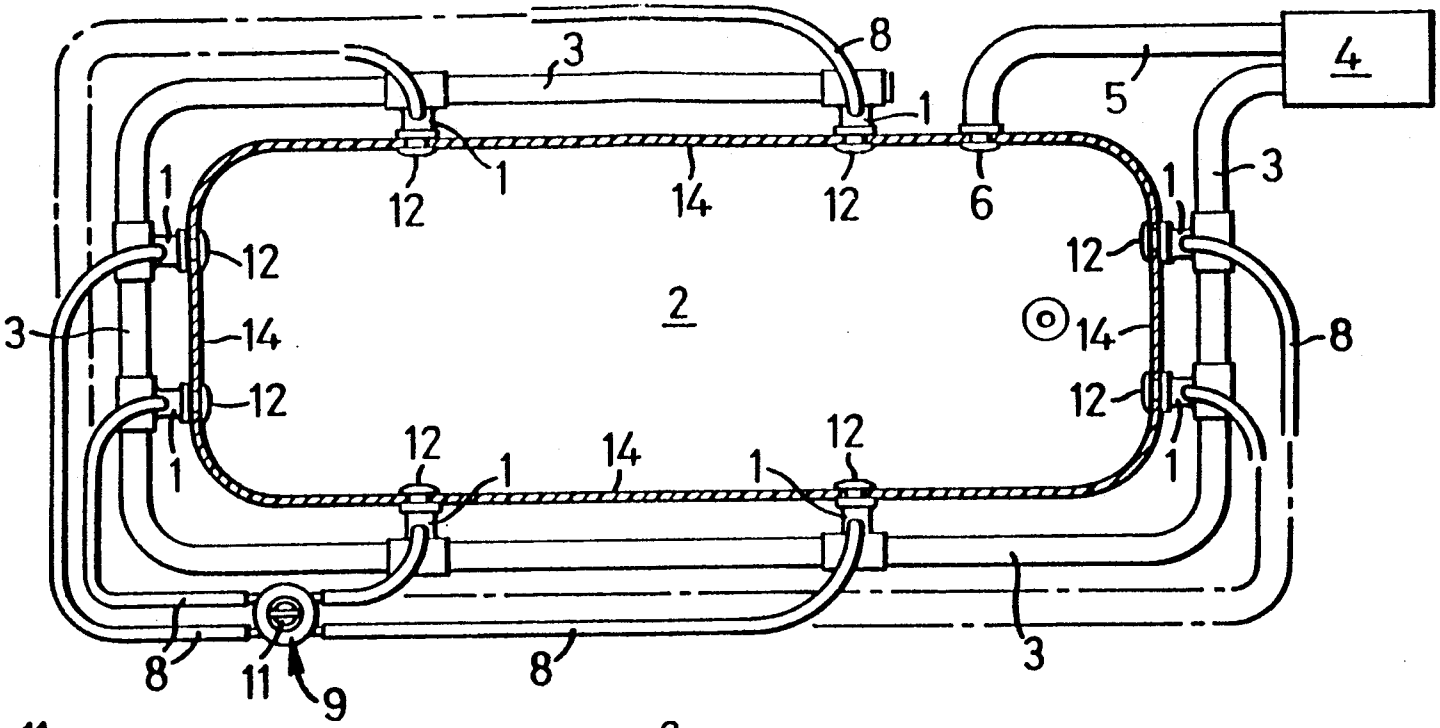

This invention relates to jet units for whirlpool-bath systems, of the kind which include a nozzle for directing a stream of water across an air-gap into a discharge outlet of the unit.

Jet or nozzle units of this above-specified kind are known for use in whirlpool-bath systems (which are sometimes referred to as hydro-massage systems) for injecting jets of water mixed with air into a tub or bath at spaced locations below the water-level, so as to create foaming and turbulence which has an invigorating and/or therapeutic effect on the one or more occupants of the bath. The jets are injected into the bath from the individual jet units, water being supplied to the nozzle under pressure from a water-supply pipe or line that encircles the bath. Air is drawn into the jet unit to be entrained with the water stream from the nozzle, by the suction that is created by venturi effect at the gap as the water issues from the nozzle. The resultant water stream is discharged as a jet into the bath from an outlet of the jet unit, and in the bath produces turbulence and a general whirlpool effect that is intensified by the entrained air.

The extent of turbulence and desired whirlpool effect created by the jet from the outlet of the jet unit is dependent upon the degree with which the air is mixed with the water stream from the nozzle. With some known forms of jet unit, mixing is very superficial and the results consequently poor, and although mixing can be improved by injecting the air into the centre of the water stream, this has practical disadvantage.

It is an object of the present invention to provide a form of jet unit of the said specified kind, by which improved mixing of air with the water stream can be achieved without the need for central air-injection.

According to one aspect of the present invention a jet unit of the said specified kind is characterised in that it includes constricting means that serves to even out distribution of air to the gap, around the stream.

The jet unit may have an air-supply inlet that opens into a chamber which surrounds the gap within the unit, and the said constricting means may surround the gap to constrict air in its passage from the chamber to the gap. The constricting means in these circumstances may be means to shroud the gap from direct entry of air from the chamber.

According to another aspect of the present invention a jet unit of the kind specified is characterised in that an air-supply inlet to the unit opens into a chamber that surrounds the gap, and the gap is shrouded to constrict air entry to the gap from the chamber.

The shrouding may define a passageway for air from the chamber to the gap that increases in cross-sectional area towards the gap. The passageway may alternatively be of substantially uniform cross-sectional area to the gap.

The nozzle may extend into the chamber to open in alignment with, but separated by said gap from, the entrance to the discharge outlet from the chamber. A skirt may surround the gap to provide the shrouding and may be such as to restrict entry of air to the gap to an annular space around the nozzle. A portion of the nozzle surrounded by the skirt, like the water passage within the nozzle, may be of reducing cross-sectional area towards the gap.

The outlet of the jet unit according to either of the aspects of the present invention identified above, may include provision for adjusting or varying the direction of discharge of the jet of water and air into the bath, but may simply provide for a fixed-direction of discharge. In the latter respect, the outlet may involve a hollow stem that is aligned with the nozzle, and this may have a circumferential skirt which projects backwardly from the stem to surround the gap and a nose-part of the nozzle. Entry of air to the gap in these latter circumstances is constricted to space between the skirt and the nose-part of the nozzle.

Figure 2:
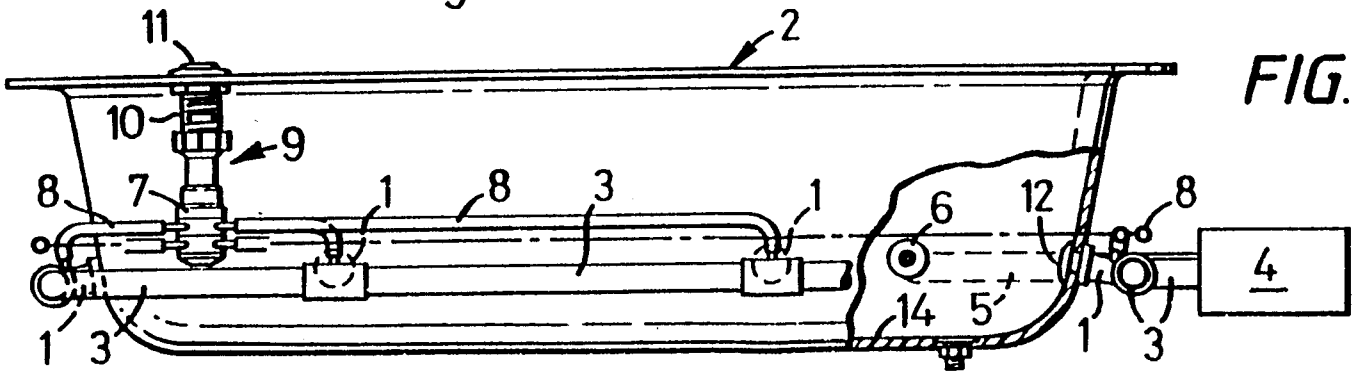
Figure 3:
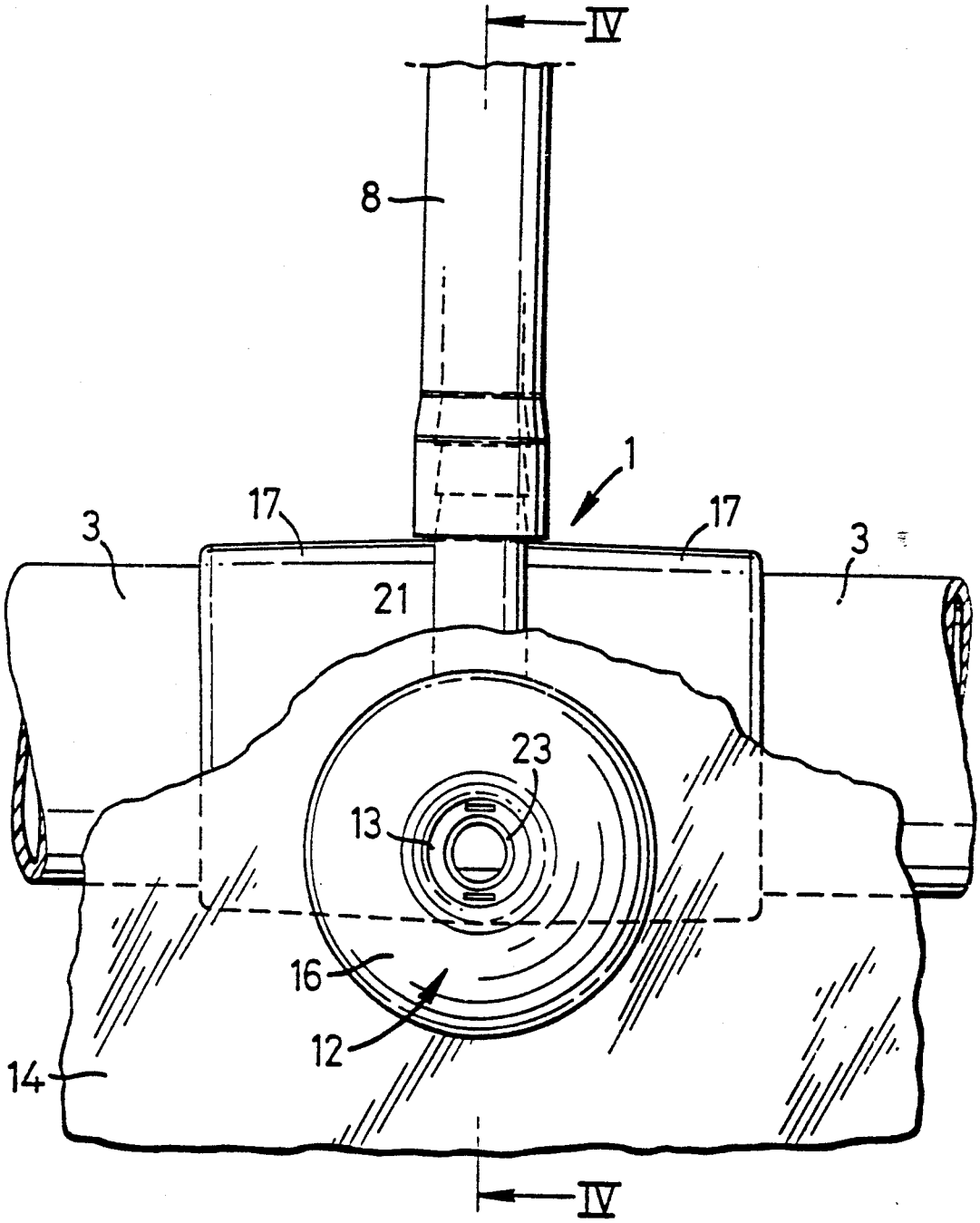
Figure 4:
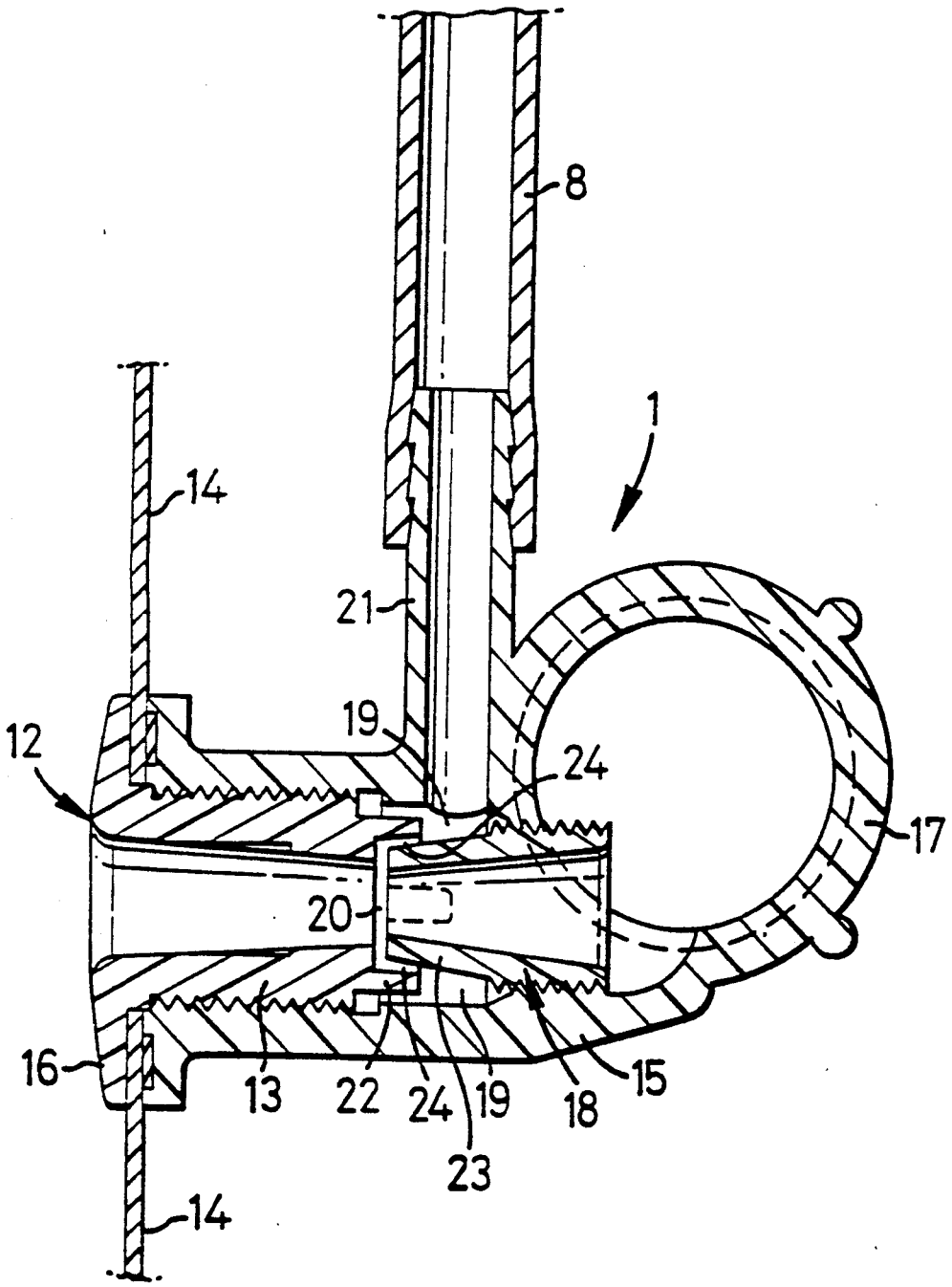
Figure 5:
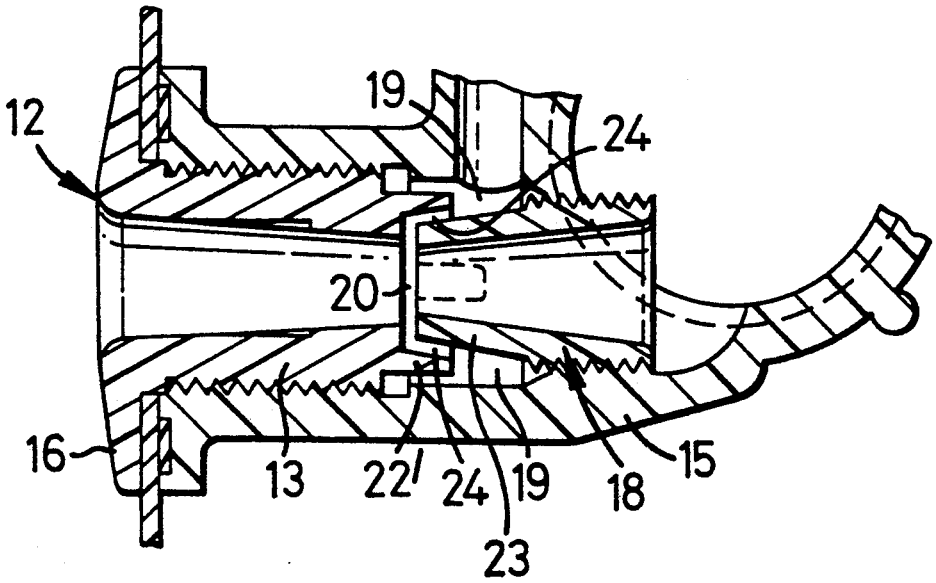

A whirlpool-bath system including jet units according to the present invention, will now be described, by way of example, with reference to the accompanying drawings, in which:

FIGS. 1 and 2 are schematic plan and side views, respectively, of the whirlpool-bath system; and FIGS. 3 and 4 are a front elevation and a sectional side-elevation, respectively, of a typical jet unit of the system, the jet unit being shown as mounted on the bath in the system of FIGS. 1 and 2, with the section of FIG. 4 taken on the line IV—IV of FIG. 3; and FIG. 5 illustrates a possible modification of a skirt of the jet unit of FIGS. 3 and 4.

Referring to FIGS. 1 and 2, the hydro-massage or whirlpool system involves eight nozzle or jet units 1 that are mounted on the tub or bath 2 (two on each side, two at the head and two at the foot) for injecting jets of water with entrained air, into the bath 2 below the normal water-level. Water is supplied to the jet units 1 under pressure via a pipe or line 3 that extends around and/or under the bath 2 from an electric pump 4. The pump 4 draws its water from the bath 2 via a pipe 5 that is coupled to an outlet 6 located below the normal water-level, near the foot of the bath 2.

Air is supplied to the jet units 1 from an eight-outlet manifold 7 (FIG. 2) via individual tubes 8. The manifold 7 is part of an air-supply assembly or controller 9 that is mounted near the head of the bath 2 and incorporates a manually-adjustable air-valve 10. The valve 10 regulates the volume or rate of air admitted to the manifold 7 and supplied to the individual tubes 8, in accordance with the setting of a manual control 11. Air is drawn from the atmosphere into the valve 10, and thence into the manifold 7 for supply via the tubes 8, under suction that is created with the injection of water into the bath 2 through the units 1.

The construction of a typical nozzle or jet unit 1 is illustrated in FIGS. 3 and 4, and will now be described.

Referring to FIGS. 3 and 4, an outlet 12 of the unit 1 has a flanged-stem 13 that extends from the inside of the tub or bath 2 through the bath-wall 14 to screw into the unit-housing 15. This clamps the unit 1 securely (and in a water-tight manner) to the bath 2 with the flange 16 of the outlet 12 against the wall 14 on the inside, and the housing 15 held hard on the outside of the bath 2.

The housing 15 has a transversely-extending tube-section 17 and it is by means of this that the unit 1 is coupled into the water-supply line 3. A nozzle 18 opens from the tube-section 17 and projects into an air chamber 19 within the housing 15; the rear end of the cylindrical stem 13 defines one wall of the chamber 19. The nozzle 18 is axially aligned with the hollow stem 13 to supply water under pressure into the outlet 12 across an air-gap 20 between the nozzle 18 and the stem 13 in the chamber 19. An air-inlet pipe 21, to which the air-tube 8 individual to the unit 1 is coupled, opens into the chamber 19. Discharge of the convergent stream of water from the nozzle 18 across the gap 20 creates suction by the venturi effect, and this suction draws air into the chamber 19 from the pipe 21. The air is entrained with the water in the gap 20 to cause a foaming and turbulent jet discharge from the divergent outlet 12.

Mixing of the air with the water in the gap 20 is enhanced by the provision of a circumferential skirt 22 that projects backwardly from the rear end of the stem 13 to shroud the gap 20. The skirt 22, in shrouding the gap 20 in this way, surrounds the gap 20 and extends over a frusto-conical nose-part 23 of the nozzle 18. This restricts admission of air to the gap 20 from the chamber 19, to the annular space 24 between the skirt 22 and nose-part 23. The shrouding of the gap 20 together with the consequent constriction of air-entry to it, serves to even out distribution of air around the stream of water from the nozzle 18.

If the shrouding were absent, the gap 20 would be open and air would be entrained mostly in that part of the water stream closest to the inlet pipe 21 within the chamber 19. This would lead to uneven distribution of air around the stream of water from the nozzle 18. As a consequence there would be superficial mixing of the air with the water, with large air-bubbles congregating together in one sector of the discharged jet and rapidly breaking away from the jet when it enters the main body of water in the bath 2. Desirably, there is an even distribution of entrained air around the water stream from the nozzle, with a large number of small bubbles mixed throughout the jet injected from the outlet 12 into the bath-water.

Even distribution of entrained air is achieved in the present case through the constriction of entry of air to the gap 20. More especially, air is constricted to enter the gap 20 through the annular space 24, so that the suction created by the water flow draws air into the gap 20 from around the whole circumference of the nozzle within the chamber 19. The constriction precludes the possibility of all, or most, of the air sucked in entering over a limited sector, and furthermore accelerates the air to enhance further the formation of small bubbles.

The convergence of the nose-part 23 towards the gap 20 is greater than the convergence of the internal surface of the skirt 22 over the nose-part 23, so the pathway for air between the nozzle 18 and the skirt 22 is of increasing cross-sectional area towards the gap 20. The internal surface of the skirt 22 might in this respect be cylindrical rather than convergent. Alternatively, as illustrated in FIG. 5 by a modified skirt 22', the internal surface may be of the same convergent angle as the nose-part 23 to give a substantially uniform cross-sectional area throughout the pathway; with this modification the cross-sectional area would remain the same irrespective of the extent to which the stem 13 is screwed into the housing 15 in clamping the unit 1 to the bath 2.

The whirlpool-system is brought into operation by switching on electric supply to the pump 4 after the bath 2 has been suitably filled with water. The pump 4 draws water ±rom the bath 2 into the pipe 5 via the outlet 6, and transfers this under pressure to the water-supply line 3. Water supplied to the line 3 issues through the nozzle 18 within the housing 15 at each of the eight jet units 1.

At each of the jet units 1, water flow from the nozzle 18 across the associated gap 20 and into the outlet 12, draws air into the system through the valve 10 at a rate dependent upon the setting of the control 11. The air as supplied from the manifold 7 to the chamber 19 of the individual unit 1 is accelerated into the annular space 24 and distributed substantially evenly around the water stream by the constricting circumferential skirt 22. The jet discharged through the outlet 12 to be injected into the bath 2 from the unit 1, in consequence contains a large number of small bubbles distributed substantially evenly throughout the cross-section of the jet and creates strong and optimum turbulence and whirlpool effect in the bath 2.

The whirlpool effect produced by the jet units 1 can be varied by adjusting the control 11 of the air-supply controller 9 to vary the volume or rate of air admitted to the chamber 19.

Although the system described above involves just eight jet units 1, more or fewer can readily be provided, each generating a powerful jet of well-mixed air and water to give the desired hydro-massage or whirlpool-bath effect. It has been found that because of their efficiency in this regard, as many as twenty jet units can be supplied with water from the one pump. This is especially advantageous in the provision of systems for baths or pools of larger capacity than that illustrated in FIGS. 1 and 2.

The construction of jet unit described makes no provision for varying the angular orientation of the issuing jet. Such provision may be made, but the simplicity of the jet unit described, with its small outlet and high efficiency, enables many more units to be accommodated in a given area than is otherwise possible, and thereby reduces much of the necessity or desirability for variable-angle jets.

Although in the whirlpool system described above, a single air-supply assembly or controller 9 is used to control air flow to all the jet units 1 of the bath, it would clearly be possible to use one or more further such assemblies to control air supply to individual groupings of the jet units, so that, for example, different jet effects could be obtained selectively in different parts of the bath. Moreover, although only one jet unit is coupled to each individual supply tube from the distribution manifold in the described systems two or more might be supplied by each such tube.

We claim:

1. A jet unit for a whirlpool-bath system which includes a discharge outlet of the unit, a nozzle spaced from the discharge outlet by an air-gap for directing a stream of water across the air-gap into the discharge outlet, wherein the air-gap is located within an air chamber defined in the unit, an air-supply inlet to the unit opens into said air chamber, and shrouding means for shrouding the air-gap for constricting air-entry into the air-gap, and the shrouding means defines a passageway for air from the chamber to the air-gap that increases in cross-sectional area towards the gap.

2. A jet unit for a whirlpool-bath system comprising a discharge outlet, means defining an air chamber that opens into the discharge outlet, a nozzle, at least partially located within the chamber and separated from the discharge outlet by an air-gap, for directing a stream of water across the air-gap into the discharge outlet, an air-supply inlet that opens into the air chamber, and shrouding means for shrouding the gap for constricting flow of air into the air-gap, said shrouding means defining a passageway, between the shrouding means and the nozzle, for the air flow into the air-gap that increases in cross-sectional area towards the air-gap.

3. A jet unit according to claim 2 wherein the discharge outlet comprises a hollow stem that is aligned with the nozzle, and said shrouding means comprises a circumferential skirt which projects backwardly from the stem to surround the gap and a nose-part of the nozzle so that entry of air to the gap is constricted to the space between the skirt and the nose-part of the nozzle.

4. A jet unit for a whirlpool-bath system comprising means defining an outlet passageway for discharge of a jet of water from the unit; means defining a chamber for supply of air to be entrained in the water jet, said chamber having a wall with an aperture therein that opens into said outlet passageway; an air inlet to said chamber; a water-discharge nozzle projecting into said chamber substantially normal to said wall and separated by an air-gap from said wall for discharging a stream of water across the air-gap into said outlet passageway through said aperture, the nozzle having an internal water-passage that converges towards the air-gap to discharge the stream of water into the air-gap with maximum construction; and shrouding means for surrounding the air-gap within said chamber between the nozzle and said wall to even out distribution of air around the water stream by constricting the flow of aspirated air into the air-gap within said chamber.

5. A jet unit according to claim 4 wherein the shrouding means defines a passageway for air from said chamber to the air-gap that is substantially uniform in cross-sectional area towards the air-gap.

6. A jet unit according to claim 4 wherein said shrouding means is a skirt that projects into said chamber from said wall to surround the air-gap for restricting entry of air to the air-gap to an annular space around the nozzle.

7. A jet unit according to claim 6 wherein the skirt projects across the air-gap to surround a portion of the nozzle, and said portion of the nozzle is of reducing cross-sectional area towards the air-gap.

8. A jet unit for a whirlpool-bath system comprising means defining an outlet passageway for discharge of a jet of water from the unit; means defining a chamber for supplying air to be entrained in the water jet, said chamber having a wall with an aperture therein to open into said outlet passageway; an air inlet to said chamber; a nozzle aligned within said chamber with the aperture and having a water-discharge orifice spaced from said wall by an air-gap for discharging a stream of water across the air-gap into said outlet passageway through said aperture, the diameter of said aperture being substantially the same as the diameter of the water-discharge orifice; and annular means concentric with said aperture and projecting from said wall to beyond the air-gap, said annular means shrouding the air-gap within said chamber between the nozzle and the aperture for evening out the distribution of air around the water stream within the air-gap by a tight construction of air flowing into the air-gap.

9. A jet unit for a whirlpool-bath system comprising a housing having an internal cavity within an open mouth; an outlet for jet discharge from the unit, said outlet comprising a hollow cylindrical stem that extends axially into the cavity through said mouth to locate an open rear end of the stem within the cavity, said stem being retained within the cavity to define an air chamber between the open rear end of the steam and the inside of the housing; an air inlet for supplying air to said chamber; a water-discharge nozzle mounted in said chamber with an open nose-portion of the nozzle in axial alignment with the stem and spaced from the stem by an air-gap for discharging a stream of water across the air-gap into the open rear end of the hollow stem; and an annular skirt for shrouding the air-gap to even out distribution of aspirated air around the water stream in the air-gap, said annular skirt extending across the air-gap from the rear end of the stem to surround the nose-portion and thereby define with the nose-portion a constricted annular passage for air flow into the air-gap.

10. A jet unit according to claim 9 wherein the hollow stem has a flanged front end for clamping the unit to the wall of a bath.

11. A jet unit according to claim 9 wherein the hollow stem is screwed into said cavity.

12. A jet unit according to claim 9 wherein at least the nose-portion of the nozzle is conical.

13. A jet unit according to claim 9 wherein the internal water-passage of the nozzle is convergent towards the air-gap within its open nose-portion, and the internal water-passage of the hollow steam is divergent away from its open rear end so that the cross-section of the water stream is constricted to a minimum within the air-gap.

14. A jet unit according to claim 9 wherein the cavity is substantially cylindrical and the nozzle is mounted substantially coaxially with the cavity.

* * * * *

UNITED STATES PATENT AND TRADEMARK OFFICE

CERTIFICATE OF CORRECTION

PATENT NO. : 5,279,003

DATED : January 18, 1994

INVENTOR(S) : Alan Frederick GAPE & Davis Simon Ormond BUTLER

It is certified that error appears in the above-identified patent and that said Letters Patent is hereby corrected as shown below:

Column 3, line 61 replace "±rom" with --from--.

Column 5, line 21 replace "construction" with --constriction--.

Column 6, line 8 replace "construction" with --constriction--;
line 17 replace "steam" with --stem--; and
line 41 replace "steam" with --stem--.

Signed and Sealed this

Twentieth Day of September, 1994

*Attest:*

Bruce Lehman

BRUCE LEHMAN

*Attesting Officer*

*Commissioner of Patents and Trademarks*